United States Patent [19]

Möll

[11] 4,398,567

[45] Aug. 16, 1983

[54] CONDUIT DEVICE

[75] Inventor: Thorleif Möll, Fjäras, Sweden

[73] Assignee: Cinderella AB, Stockholm, Sweden

[21] Appl. No.: 197,330

[22] Filed: Oct. 15, 1980

[30] Foreign Application Priority Data

Oct. 15, 1979 [NO] Norway ..... 793313

[51] Int. Cl.[3] ..... F16L 9/18

[52] U.S. Cl. ..... 138/113; 138/111; 138/114; 138/148

[58] Field of Search ..... 138/111, 112, 113, 114, 138/148; 165/159, 160, 161, 156, 154, 172

[56] References Cited

U.S. PATENT DOCUMENTS

| | | | |
|---|---|---|---|
| 1,777,356 | 10/1930 | Fisher | 165/160 |
| 1,817,948 | 8/1931 | Smith | 165/159 X |
| 1,852,489 | 4/1932 | Sullivan . | |
| 1,852,490 | 4/1932 | Sullivan | 165/160 |
| 2,693,346 | 11/1954 | Petersen | 165/160 |
| 3,477,412 | 11/1969 | Kitrilakis | 165/159 X |

*Primary Examiner*—James E. Bryant, III

*Attorney, Agent, or Firm*—Lowe, King, Price & Becker

[57] ABSTRACT

A device for conducting a fluid in heat transfer relationship with another liquid comprises a conduit through which the fluid flows to be heated or cooled by the other fluid flowing around the conduit. An elongated, thread like element helically extends around the conduit with the windings spaced from each other, causing the fluid flowing around the conduit to undergo circulation for improved heat transfer relationship.

4 Claims, 4 Drawing Figures

CONDUIT DEVICE

TECHNICAL FIELD

The present invention relates to a device for conducting a fluid, for example liquid state freon or another liquid, comprising a conduit through which the fluid is conducted in order to be heated or cooled by means of a medium flowing around the conduit.

Devices of this kind are used in for example heating systems for preheating the heat carrier liquid.

BACKGROUND ART

The object of the invention is to provide a device of the kind described above, in which the heat transmission between the fluid which is conducted through the conduit and the medium flowing around the conduit is better than in the devices previously known.

DISCLOSURE OF INVENTION

In order to comply with this object the device according to the present invention is characterized in that a longitudinal, for example thread shaped, element is helically positioned around the conduit with the windings spaced from each other in order to bring the medium flowing around the conduit to perform a circulating motion around the conduit.

In a preferred embodiment of the invention the device comprises at least two conduits each provided with a helical element, the conduits being positioned adjacent each other in parallel relationship while maintaining a distance between the conduits by means of the helically extending elements in order to allow the flowing medium to circulate between the conduits.

It is suitable that the conduits positioned together in parallel with each other are provided in an outer pipe, through which the flowing medium is conducted, and that said outer pipe and the conduits positioned therein extend helically.

By means of the device according to the invention there is provided a more effective heat transmission between the outer side of the conduit and the medium flowing around the conduit. The conduits can be positioned close to each other inside the outer pipe without causing the outer surfaces of the conduits to contact each other and thereby to obstruct the flowing of the medium outside the conduits.

Because of the fact that the flowing medium is brought to perform a circulating motion and the heat transmission to the conduits is thereby improved it is possible to reduce the dimensions of the device.

An embodiment of the invention is described in the following with reference to the accompanying drawing.

BRIEF DESCRIPTION OF THE DRAWINGS

FIG. 1*c* is a section on an enlarged scale showing another portion of the device according to FIG. 1*a.

DETAILED DESCRIPTION OF THE INVENTION

Figure 1A:
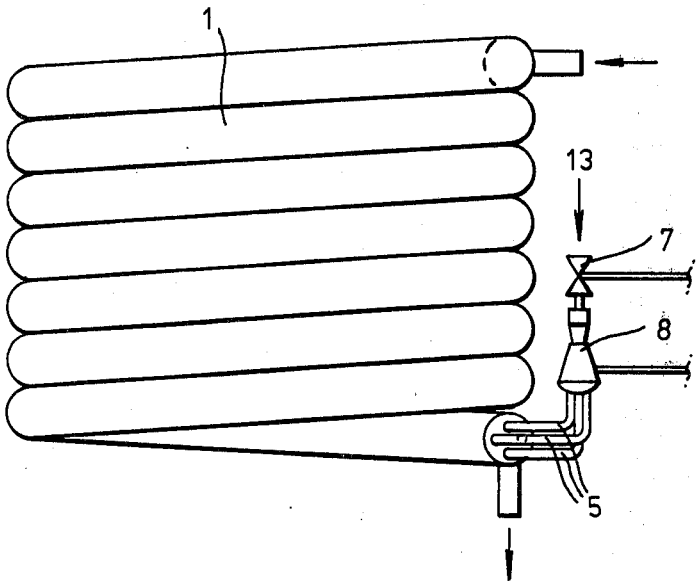
FIG. 1*a* is a side view of a device according to the invention.
Figure 1C:
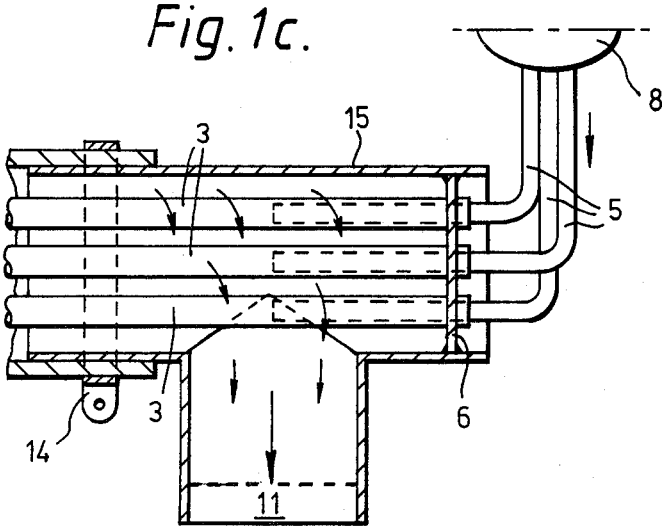
Figure 1B:
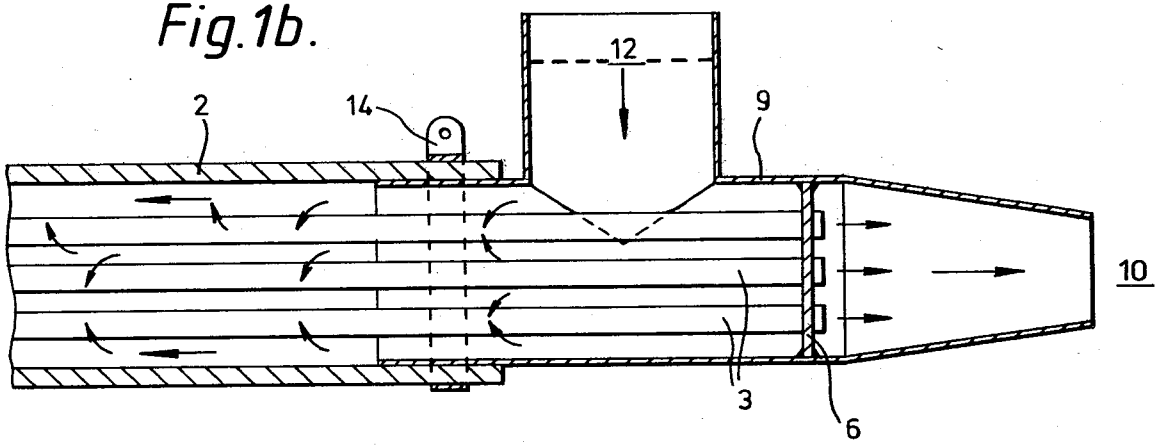
FIG. 1*b* is a section on an enlarged scale showing a portion of the device according to FIG. 1*a;*
Figure 2:
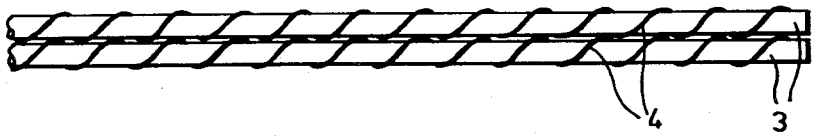
* and FIG. 2 shows two conduits forming a part of the device according to the invention.

A freon liquid is fed in the direction of the arrow 13 through an expansion valve 7 and a distribution head 8 to pipes 5 and conduits 3 connected therewith as shown in FIG. 1. A helically extending element 4 (FIG. 2), preferably consisting of copper wire, extends around each of the conduits 3. The windings of the elements 4 are spaced from each other. The conduits 3 extend in common into a wider outer pipe 2 (FIG. 1*b*) preferably consisting of polyethylene and the like, formed in the shape of a helix 1. The lower end of the helix 1 is connected with a pipe section 15, by means of a hose clamp 14, the pipe section 15 having an outlet 10 for a medium, preferably water, which is supplied to the outer pipe 2 at the upper end thereof. Inside the pipe section 15 the pipes 5 extend through a sealed end portion 6 and into the conduits 3.

The upper end of the helix 1 is connected with a pipe section 9 by means of a hose clamp 14, the pipe section 9 having an inlet 12 for a hot medium, preferably water, and an outlet 10 for the heated freon liquid, the pipes 3 being fixed and spaced apart from each other by means of a seal end portion 6, as shown in FIG. 1*b*.

The invention can be modified within the scope of the following claims.

I claim:

1. A device for conducting a first fluid in heat transfer relationship with a second fluid, comprising a plurality of conduits each containing the first fluid; an outer pipe carrying the conduits and containing a second fluid flowing around the conduits; and a thread shaped element helically wrapped substantially around each of the conduits with the the element windings around each conduit longitudinally spaced from each other to cause the second fluid flowing around the conduit to perform a circulating motion, said element having substantially an entire length and a surface thereof in continuous contact with the conduit, said element being at least partially spaced apart from said outer pipe along a common longitudinal plane extending radially through the conduit, enabling fluid to flow therebetween, said conduits being substantially parallel to the longitudinal axis of said outer pipe and spaced apart from each other radially toward the outer pipe by means of the helically extending elements wherein said windings of each element are offset axially relative to corresponding windings provided on an adjacent conduit, said windings on one conduit thereby contacting an adjacent conduit to radially space adjacent conduits from each other in the outer pipe a distance substantially equal to the diameter of an element interposed therebetween, said windings defining a continuous clearance between adjacent conduits extending substantially the entire axial length of said elements, enabling second fluid flow between adjacent conduits through the continuous clearance.

2. A device as claimed in claim 1, wherein said outer pipe and conduits are arranged as a helix.

3. A device as claimed in claim 1 or 2, wherein each element is entirely spaced away from the conduit carrying means.

4. A device according to claim 1, further including means for spacing said conduits apart from each other and the conduit carrying means.

* * * * *